US006988689B2

(12) United States Patent
Thomas et al.

(10) Patent No.: US 6,988,689 B2
(45) Date of Patent: Jan. 24, 2006

(54) HANDS-FREE TOWEL DISPENSER WITH EMF CONTROLLER

(75) Inventors: Timothy Thomas, Louisville, KY (US); Adam Troy Elliott, Lexington, KY (US)

(73) Assignee: Bay West Paper Corporation, Harrodsburg, KY (US)

( * ) Notice: Subject to any disclaimer, the term of this patent is extended or adjusted under 35 U.S.C. 154(b) by 99 days.

(21) Appl. No.: 10/684,214

(22) Filed: Oct. 10, 2003

(65) Prior Publication Data

US 2005/0077419 A1 Apr. 14, 2005

(51) Int. Cl.
*B65H 26/00* (2006.01)

(52) U.S. Cl. ..... 242/563; 242/563.2; 242/564.1; 242/564.3

(58) Field of Classification Search ..... 242/563, 242/563.2, 564.1, 564.3, 564.4
See application file for complete search history.

(56) References Cited

U.S. PATENT DOCUMENTS

| | | | |
|---|---|---|---|
| 1,108,855 | A | 8/1914 | Simons |
| 1,716,812 | A | 6/1929 | Ball |
| 2,299,626 | A | 10/1942 | Hunt |
| 2,703,681 | A | 3/1955 | Jacobs |
| 2,726,823 | A | 12/1955 | Jespersen |
| 2,905,405 | A | 9/1959 | Burton et al. |
| 3,084,006 | A | 4/1963 | Roemer |
| 3,085,762 | A | 4/1963 | Subklew |
| 3,126,234 | A | 3/1964 | Batlas et al. |
| 3,211,504 | A | 10/1965 | Bump |
| 3,214,014 | A | 10/1965 | Perrin |
| 3,294,329 | A | 12/1966 | Tucker et al. |

(Continued)

FOREIGN PATENT DOCUMENTS

| | | | |
|---|---|---|---|
| GB | 2 245 882 | A | 1/1992 |

(Continued)

OTHER PUBLICATIONS

LaCour Systems, Inc. *ille Toweltronic* brochure, undated. (1 pg.).

*Primary Examiner*—John Q. Nguyen
(74) *Attorney, Agent, or Firm*—Merchant & Gould P.C.

(57) ABSTRACT

A hands-free towel dispenser comprising a housing with a roll of towels inside an interior, a sensor for detecting the presence of an object and generating a signal, a motor driving a dispensing means for dispensing a desired length of towel, a control circuit for receiving the signal from the sensing means and controlling supply of power to the motor driving the dispensing mechanism, and a battery. The control circuit is adapted to sample back EMF generated by the motor while the dispensing means is dispensing the towel and to determine based on the sampled back EMF a calculated run time for the operation of the motor to dispense the desired length of towel. A method of dispensing a desired length of towel wherein a sensor generates a signal when the presence of an object is sensed. A control circuit receives the signal from the sensor and supplies power from a battery to a motor to drive a dispensing means to dispense a desired length of towel from the roll. The control circuit determines the speed of operation of the motor driving the dispensing means by using back EMF signals generated by the motor. The control circuit calculates a calculated run time the motor should drive the dispensing means to dispense the desired length of towel based on the speed of operation of the motor as determined from the back EMF signals generated by the motor. The control circuit stops the supply of power to the motor when the motor has run for the calculated run time.

31 Claims, 12 Drawing Sheets

U.S. PATENT DOCUMENTS

| | | | |
|---|---|---|---|
| 3,381,909 | A | 5/1968 | Tucker et al. |
| 3,387,902 | A | 6/1968 | Perrin et al. |
| 3,433,355 | A | 3/1969 | Smith |
| 3,437,388 | A | 4/1969 | Jespersen |
| 3,438,589 | A | 4/1969 | Jespersen |
| 3,647,159 | A | 3/1972 | Bump |
| 3,650,487 | A | 3/1972 | Bahnsen |
| 3,730,409 | A | 5/1973 | Ratti |
| 3,971,607 | A | 7/1976 | Schnyder |
| 4,108,513 | A | 8/1978 | Lander |
| 4,108,547 | A | 8/1978 | Stemmle |
| 4,119,255 | A | 10/1978 | D'Angelo |
| 4,131,044 | A | 12/1978 | Cassia |
| 4,165,138 | A | 8/1979 | Hedge et al. |
| 4,195,787 | A | 4/1980 | Thomason |
| 4,398,310 | A | 8/1983 | Lienhard |
| 4,522,346 | A | 6/1985 | Jespersen |
| 4,557,426 | A | 12/1985 | Siciliano |
| 4,666,099 | A | 5/1987 | Hoffman et al. |
| 4,738,176 | A | 4/1988 | Cassia |
| 4,765,555 | A | 8/1988 | Gambino |
| 4,796,825 | A | 1/1989 | Hawkins |
| 4,826,262 | A | 5/1989 | Hartman et al. |
| 4,903,909 | A | 2/1990 | Suzuki |
| 4,944,464 | A | 7/1990 | Zelenka |
| 4,960,248 | A | 10/1990 | Bauer et al. |
| 5,031,258 | A | 7/1991 | Shaw |
| 5,060,323 | A | 10/1991 | Shaw |
| 5,086,526 | A | 2/1992 | Van Marcke |
| 5,131,302 | A | 7/1992 | Watanabe |
| 5,217,035 | A | 6/1993 | Van Marcke |
| 5,236,141 | A | 8/1993 | Kewin |
| 5,294,192 | A | 3/1994 | Omdoll et al. |
| 5,310,129 | A | 5/1994 | Whittington et al. |
| 5,356,086 | A | 10/1994 | Takagi |
| 5,452,832 | A | 9/1995 | Niada |
| 5,605,001 | A | 2/1997 | Derk |
| 5,636,812 | A | 6/1997 | Conner et al. |
| 5,749,538 | A | 5/1998 | Brown et al. |
| 5,772,291 | A | 6/1998 | Byrd et al. |
| 5,829,713 | A | 11/1998 | Kewin |
| 5,833,169 | A | 11/1998 | Morand |
| 6,056,261 | A | 5/2000 | Aparicio et al. |
| 6,069,354 | A | 5/2000 | Alfano et al. |
| 6,105,898 | A | 8/2000 | Byrd et al. |
| 6,293,486 | B1 | 9/2001 | Byrd et al. |
| 6,302,352 | B1 | 10/2001 | Applegate |
| 6,386,479 | B1 | 5/2002 | Lewis et al. |
| 6,412,655 | B1 | 7/2002 | Stuetzel et al. |
| 6,412,679 | B2 | 7/2002 | Formon et al. |
| 6,419,136 | B2 | 7/2002 | Formon et al. |
| 6,491,251 | B1 | 12/2002 | Stanland et al. |
| 2002/0088837 | A1 | 7/2002 | Formon et al. |

FOREIGN PATENT DOCUMENTS

| | | |
|---|---|---|
| GB | 2 247 623 A | 3/1992 |
| WO | WO 99/09755 | 9/1990 |
| WO | WO 99/58040 | 11/1999 |

82

HANDS-FREE TOWEL DISPENSER WITH EMF CONTROLLER

TECHNICAL FIELD

The present invention relates generally to hands-free towel dispensers. More specifically, the present invention relates to hands-free towel dispensers using back EMF to measure and control the length of towel dispensed.

BACKGROUND

Paper towel dispensers are often provided in public bathrooms, adjacent to sinks and in other areas where a convenient and disposable drying medium is desired. Known paper towel dispensers may utilize proximity, light, or motion sensors to detect when a individual towel or a length of a continuous roll of towels should be dispensed. When dispensing a length of towel from a continuous roll of towels, these dispensers may be provided with a means for determining when an adequate length of towel has been dispensed. The means may include driving a dispenser motor for a fixed length of time or sensing the number of rotations of the roll of towels or a dispensing mechanism. For safety and convenience reasons, these towel dispensers may also be powered by batteries, photovoltaic cells or similar power sources. Commonly owned U.S. Pat. Nos. 5,772,291, 6,105,898, and 6,293,486 disclose automated towel dispensers and the disclosures of these patents are incorporated herein by reference.

Prior art towel dispensers, such as those found in the above-referenced patents, may sense the complete rotation of a drive roller of a known diameter to dispense the desired length of towel. Upon receiving a signal from a sensor, a drive motor rotates the drive roller which dispenses a towel from a continuous roll. When the drive roller has made a full revolution, a magnetically activated switch may halt the motor. The length of towel dispensed is roughly equal to the circumference of the drive roller. To modify the dispenser to deliver towels of different length, a drive roller of a different diameter may be installed in the dispenser.

Improvements to these known towel dispensers are desirable so that control of the length of towel dispensed in enhanced.

SUMMARY OF THE INVENTION

A hands-free towel dispenser comprising a housing with a roll of towels inside an interior, a sensor for detecting the presence of an object and generating a signal, a motor driving a dispensing means for dispensing a desired length of towel, a control circuit for receiving the signal from the sensing means and controlling supply of power to the motor driving the dispensing mechanism, and a battery. The control circuit is adapted to sample back EMF generated by the motor while the dispensing means is dispensing the towel and to determine based on the sampled back EMF a calculated run time for the operation of the motor to dispense the desired length of towel.

A method of dispensing a desired length of towel comprising, providing a roll of towels within a housing, a sensor for sensing the presence of an object, a battery and a motor driving a dispensing means. The sensor generates a signal when the presence of an object is sensed. A control circuit receives the signal from the sensor and supplies power from the battery to the motor to drive the dispensing means to dispense a desired length of towel from the roll. The control circuit determines the speed of operation of the motor driving the dispensing means by using back EMF signals generated by the motor. The control circuit calculates a calculated run time the motor should drive the dispensing means to dispense the desired length of towel based on the speed of operation of the motor as determined from the back EMF signals generated by the motor. The control circuit stops the supply of power to the motor when the motor has run for the calculated run time.

BRIEF DESCRIPTION OF THE DRAWINGS

The accompanying drawings, which are incorporated in and constitute a part of the description, illustrate several aspects of the invention and together with the detailed description, serve to explain the principles of the invention. A brief description of the drawings is as follows.

DETAILED DESCRIPTION

Reference will now be made in detail to exemplary aspects of the present invention which are illustrated in the accompanying drawings. Wherever possible, the same reference numbers will be used throughout the drawings to refer to the same or similar parts.

The term "hands-free" means control of a dispensing means without the need for use of hands to touch the dispenser.

The term "towel" refers generally to an absorbent paper or other suitable material used for wiping or drying.

Figure 1:
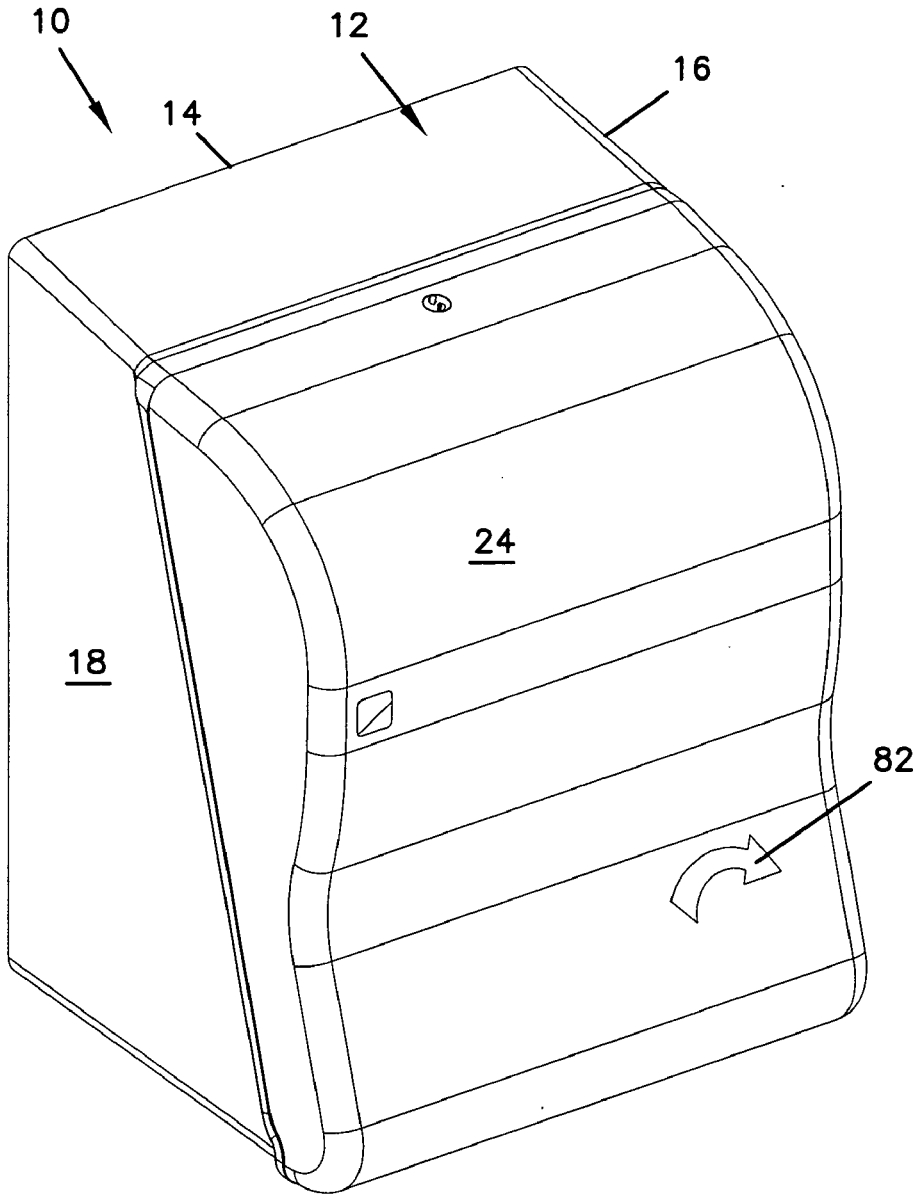
FIG. 1 is a front perspective view of an embodiment of a towel dispenser according to the present invention.
Figure 2:
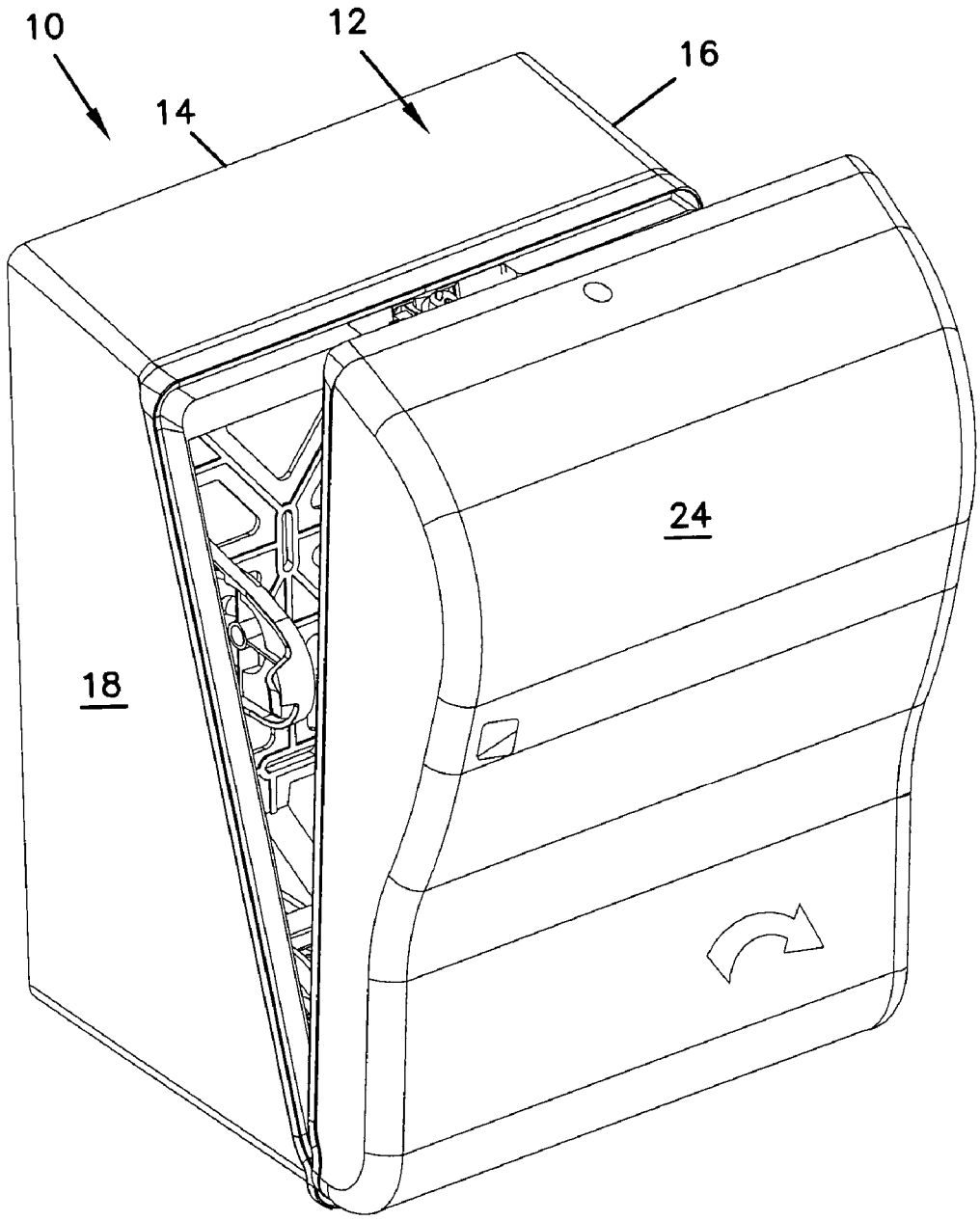
FIG. 2 is a front perspective view of the dispenser of FIG. 1, with the cover partially opened.

As shown in FIGS. 1 and 2, in a preferred embodiment of the invention, a hands-free towel dispenser 10 comprises a cabinet 12 comprising a back wall 14, two side walls 16, 18, a top wall 20, a bottom or base wall 22 (shown in FIGS. 3 and 4, below), and an openable and closeable front cover 24. Front cover 24 may be pivotally attached to the cabinet, for example, by hinge 26 (shown in FIGS. 3 and 4, below), for easy opening and closing of cover 24 when a supply of towels such as main roll 28 (not shown) is placed in the cabinet 12. Towel dispenser 10 may be mounted to a wall or other supporting member by any convenient means such as brackets, adhesives, nails, screws or anchors (not shown).

Figure 3:
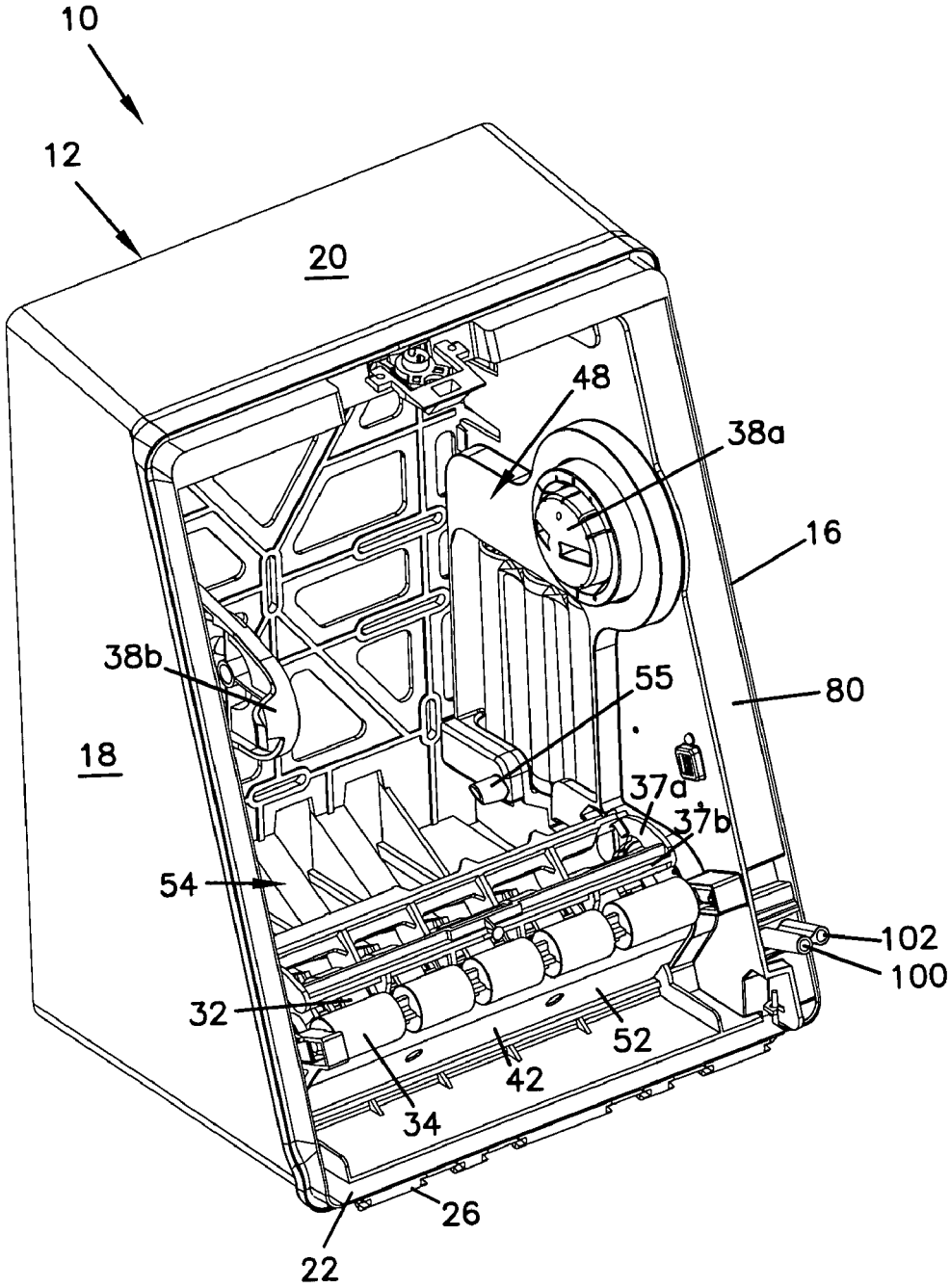
FIG. 3 is a front perspective view of the towel dispenser of FIG. 1 with the front cover and the transfer bar removed.
Figure 4:
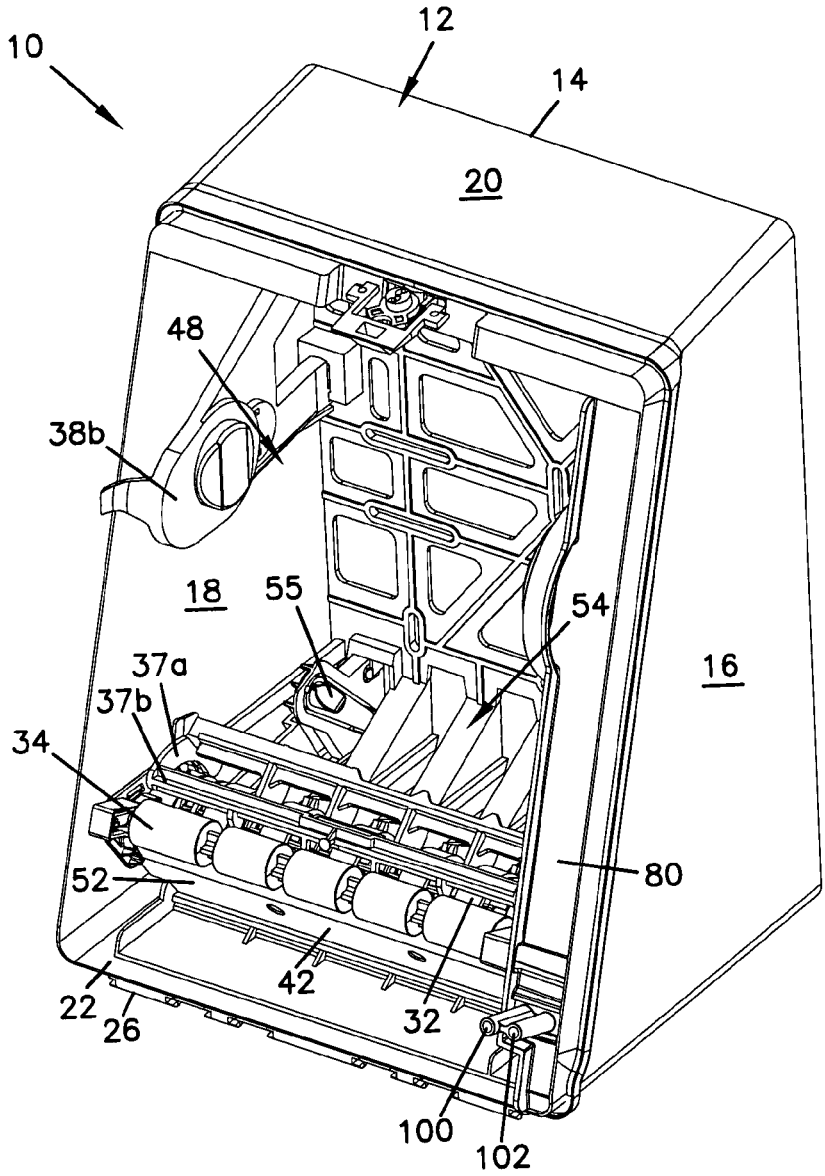
FIG. 4 is a second front perspective view of the towel dispenser of FIG. 3.
Figure 5:
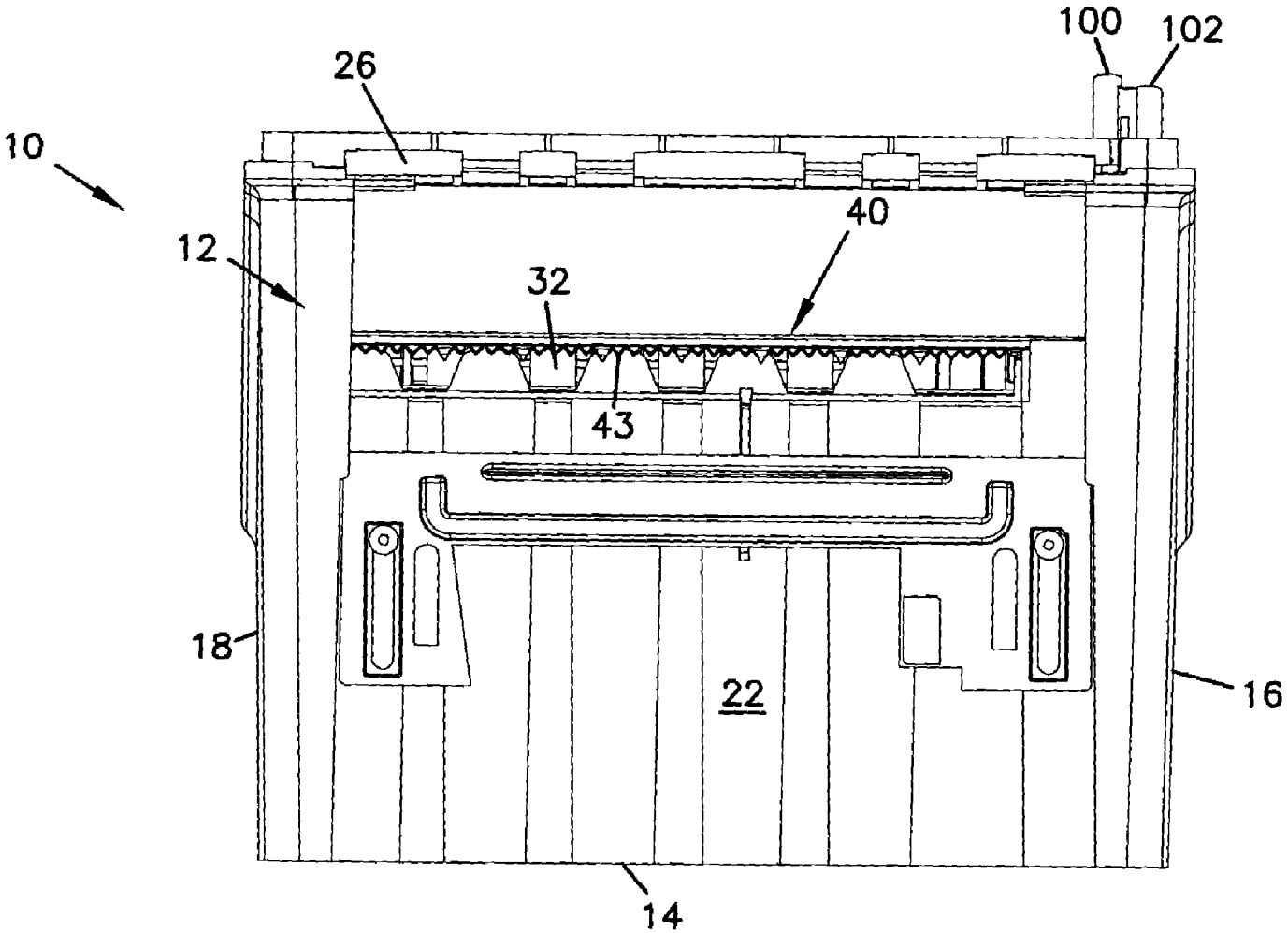
FIG. 5 is a bottom view of the towel dispenser of FIG. 3.
Figure 7:
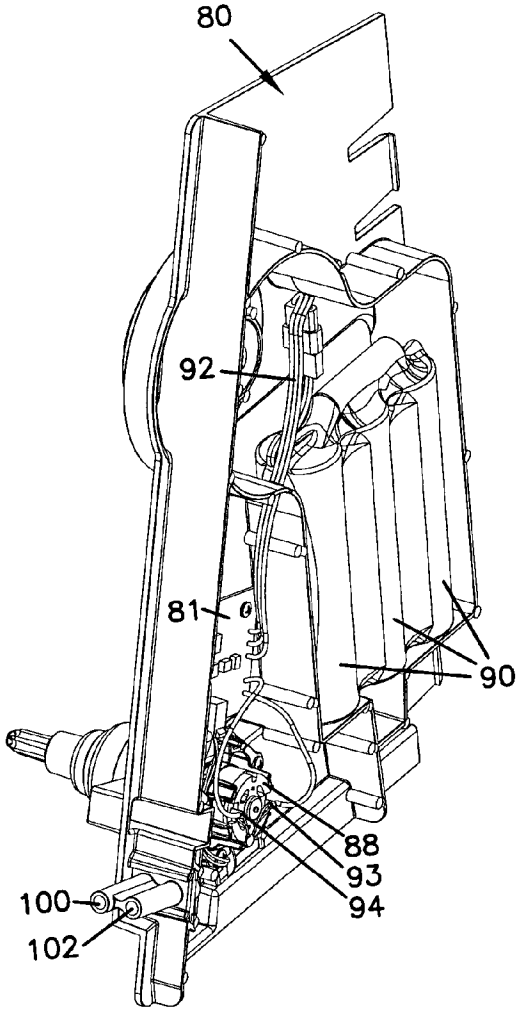
FIG. 7 is a second front perspective view of the side mounting plate of FIG. 6.
Figure 6:
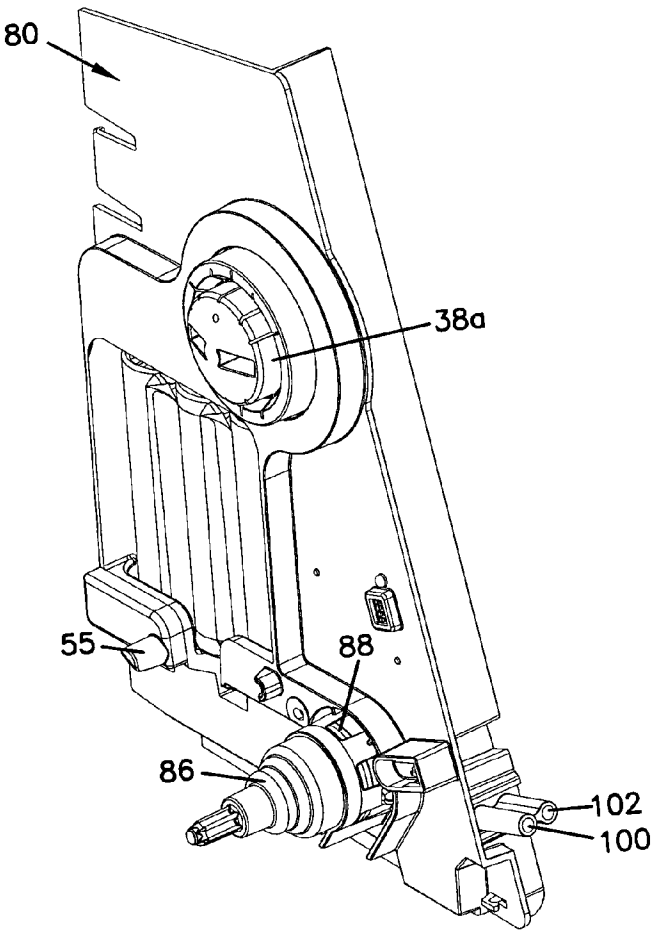
FIG. 6 is a front perspective view of a side mounting plate for mounting within the towel dispenser of FIG. 3.
Figure 8:
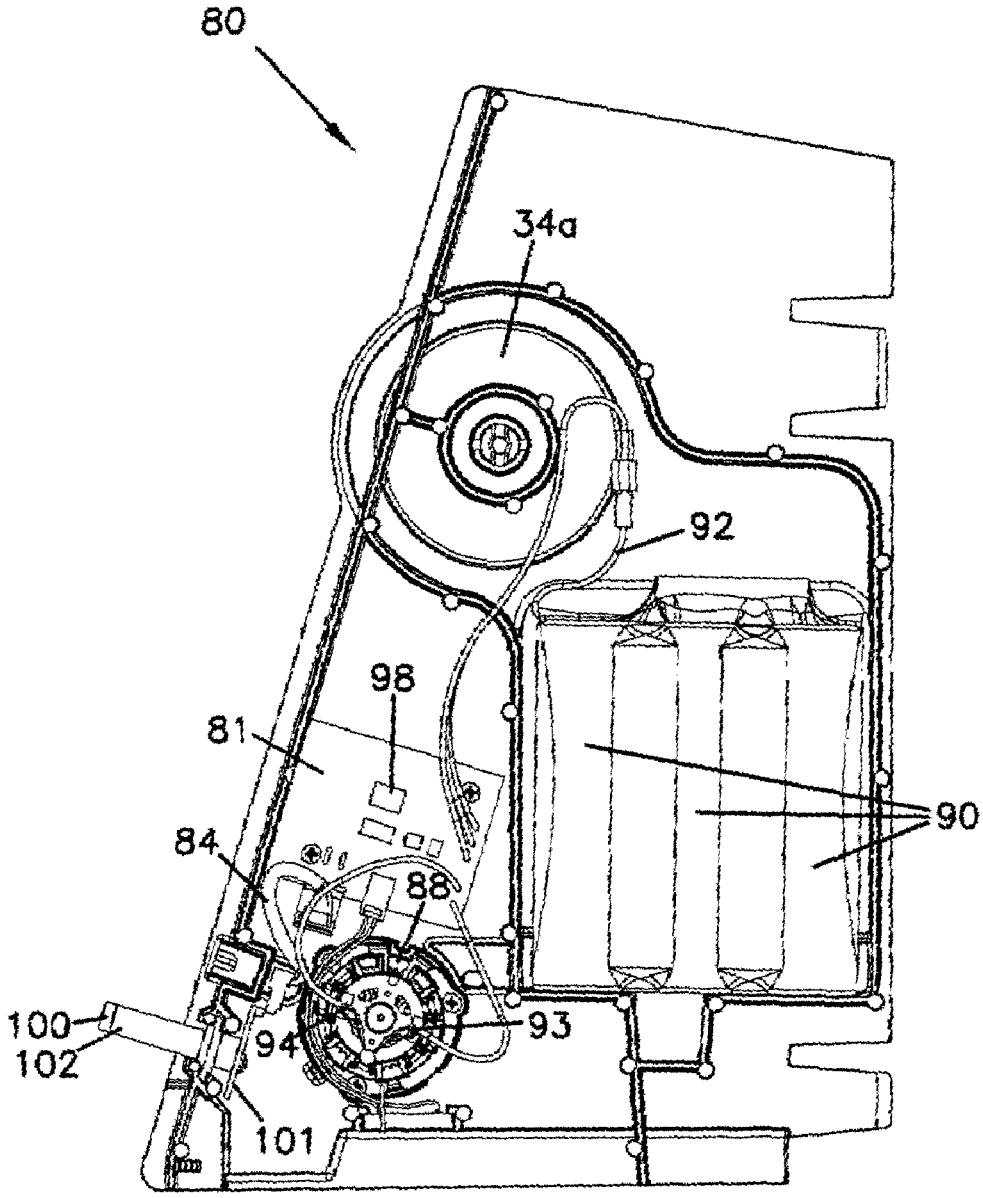
FIG. 8 is a side view of the side mounting plate of FIG. 6.
Figure 9:
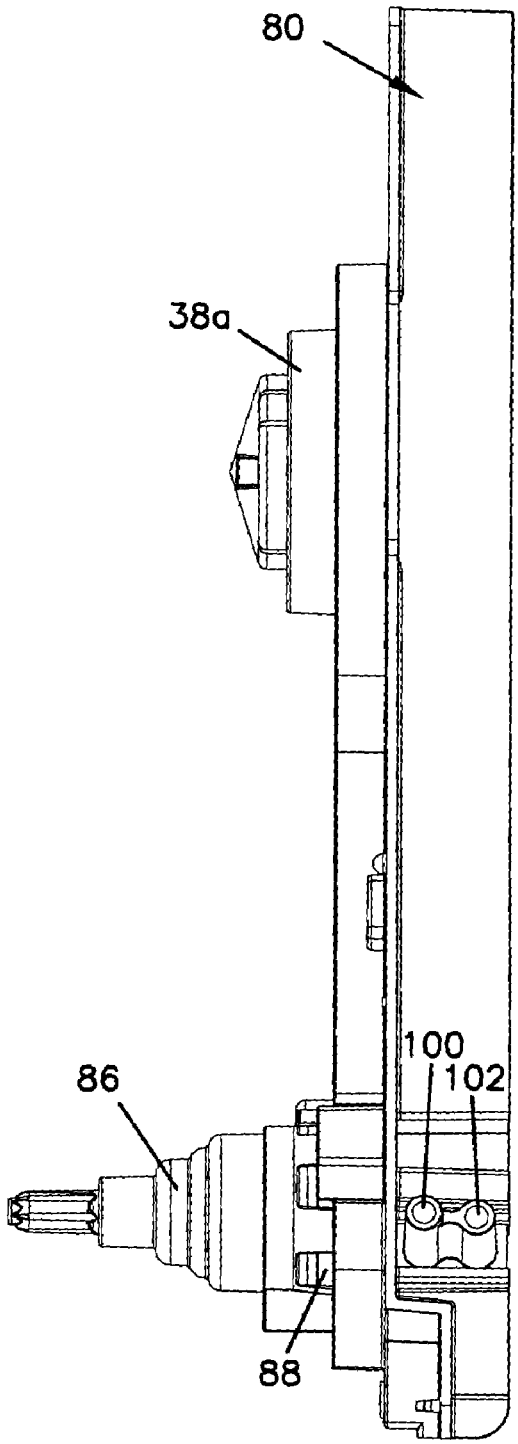
FIG. 9 is a front view of the side mounting plate of FIG. 6.

As shown in more detail in FIGS. 3, 4 and 5, hands-free dispenser 10 further comprises a dispensing means for dispensing a length of towel to the outside of dispenser 10. Such dispensing means may comprise drive roller 32, pinch roller 34 and roll support cup 38A and roll, support arm 38B. The dispensing means enables dispensing of a predetermined length of towel to the outside of towel dispenser 10 through slot 40, where the towel can be grasped by the user and torn off along a serrated edge 43 of a blade 42.

The dispensing means operates to dispense towels either from a main roll 28 (not shown) situated between roll support cup 38A and support arm 38B, or a stub roll 30 (not shown) situated in stub roll station 54 between a pair of roll holders 55. The means for controlling dispensing of paper from main roll 28 once stub roll 30 has been depleted comprises a transfer bar 36, which is not shown in the FIGS., but which is described in detail, along with main roll 28 and stub roll 30, in U.S. Pat. No. 4,165,138, the disclosure of which is incorporated by reference herein.

As shown in FIGS. 1 through 4, main roll 28 is first loaded into cabinet 12 onto roll support cup 38A and roll support arm 38B located opposite each other on side walls 16, 18, respectively, and forming main roll station 48 (as shown in FIGS. 3 and 4). A length of towel from main roll 28 is then threaded behind transfer bar 36 including a fork 37A and a cam 37B, and over drive roller 32 so that towel sheeting 50 will be pulled between drive roller 32 and pinch roller 34 in a generally downward motion when drive roller 32 is rotated by operation of a motor 88 shown in FIGS. 6 to 9, below. As towel sheeting 50 is pulled downwardly, it is guided along a wall 52 of serrated blade 42 and out slot 40.

The length of towel sheeting 50 dispensed from towel dispenser 10 can be set to any desired length. Preferably, dispenser 10 releases about ten to twelve inches of towel sheeting 50 per dispensing cycle. Towel sheeting 50 is then removed by tearing the length of dispensed towel sheeting 50 at serrated edge 43 of blade 42.

When main roll 28 has been partially depleted, dispenser cover 24 is opened by an attendant, and main roll 28 is moved down to a stub roll station 54. Main roll 28 then becomes stub roll 30 and enables a new main roll 28 to be loaded onto roll support cup 38A and roll support arm 38B in main roll station 48. When stub roll 30 is completely depleted new main roll 28 begins feeding paper 50 between drive roller 32 and pinch roller 34 out of dispenser 10 when motor 88 is activated.

When new main roll 28 is low, the attendant opens cover 24, an empty core (not shown) of stub roll 30 is removed from stub roll station 54 and discarded, and new main roll 28 is dropped into position into stub roll station 54 where it then becomes stub roll 30 and continues feeding. A main roll 28 is then positioned on roll support cup 38*a* and roll support arm 38*b*. The basic transfer mechanism for continuously feeding towels from a stub roll until completely used and then automatic transfer to a main roll is described in detail in U.S. Pat. No. 4,165,138.

Hands-free operation of dispenser 10 is effected when a person places an object such as their hands in front of a sensor mounted behind front cover 24, such as behind the arrow indicator 82 shown in FIGS. 1 and 2. Placing an object in front of indicator 82 activates motor 88 to dispense a predetermined length of towel sheeting 50. Dispenser 10 has electric circuitry which, as will be described below with reference to the FIGS. below, ensures safe, efficient and reliable operation of dispenser 10.

Referring now to FIGS. 6 through 9, a mechanical plate 80 of dispenser 10 is shown, including a circuit board 81 and a sensor circuit board 101. Note that circuit board 81 is mounted between mechanical plate 80 and wall 16 of cabinet 12. Sensor circuit board 101 has a transmitter 100 and a receiver 102 mounted to it and is connected to circuit board 81 by a sensor cable 84. The operation of sensor circuit board 101 is described in more detail below.

As was described in incorporated U.S. Pat. No. 6,293,486, a photo sensor could be used in place of transmitter 100 and receiver 102 and would react to changes in light intensity. Such a photo sensor might sense ambient light conditions in the room where dispenser 10 is mounted.

Also shown in FIGS. 6 to 9 is motor 88 which is attached to drive roller 32. Motor 88 as shown, including a gearbox 86, are available from Skil Corporation in Chicago, Ill. Other motors and gearboxes of similar design and function may be also be used for motor 88 and gear box 86. Motor 88 is placed partially within drive roller 32 and is powered by a battery or series of batteries 90. Other batteries of comparable specifications may be used for battery 90. Battery 90 may be capable of being recharged or may be a single use battery, as shown. Battery 90 is coupled to the motor 88 via circuit board 81 by wires or leads 92 which are connected or soldered to circuit board 81. As dispenser 10 is likely to be installed adjacent wet or damp conditions, it desirable that the power supply be a relatively low voltage direct current power source to reduce the risk of shock. An external power source providing such a direct current voltage may be used in place of or in addition to battery 90. Such alternative power sources may include but are not limited to a transformer connected to an outlet, a solar panel, or other sources or combination of sources which may be used to provide power to dispenser 10.

Circuit board 81 includes a control circuit 98 for determining the length of time motor 88 should operate to dispense the desired length of towel. Control circuit 98 includes circuits which monitor and record electromagnetic fields (EMF) generated by motor 88 when motor 88 is spinning. All electrical motors such as motor 88 produce EMF energy as the windings of the motor move through a magnetic field as it spins. This electrical energy produced is in opposition to any electrical energy that is used to make the motor spin and is referred to as back EMF. While energy is being delivered to motor 88 to produce motion and spin roller 32, motor 88 is producing back EMF energy that is additive to the supplied energy to produce a combined energy signal that can be detected at power terminals 93 and 94 of motor 88. For a direct current (DC) motor such as motor 88, the back EMF produced can be detected as a small signal riding on the DC voltage that is powering the motor.

The back EMF signal includes a pulse which is produced as each winding or coil of a rotating motor shaft of motor 88 passes through a magnetic field of permanent magnets of motor 88. The relationship of pulses of back EMF to the passage of the coils through the magnetic field the winding can be determined and from this relationship, the number of pulses in the back EMF can be related to the rotation of the shaft of motor 88. The generation of back EMF by electrical motors and correlation of back EMF to passage of coils through the magnetic field of a motor are well known. The coils of motor 88 are relatively evenly spaced about the shaft of motor 88, so that a pulse of back EMF sensed at terminals 93 and 94 can be related to a certain angular displacement of the shaft. By sensing and recording the back EMF at fixed time intervals or recording the time of each pulse of back EMF, the rotational speed of the shaft may be calculated.

Once the rotational speed of the shaft is known, any gear ratios within the gearbox will determine the relationship between the speed of rotation of the shaft and the speed of rotation of drive roller 32. From the speed of drive roller 32 and the time of operation of motor 88, the length of towel dispensed can be determined.

As noted above, the back EMF signal that is produced by motor 88 will appear as a small signal riding on the voltage that is powering motor 88. However, the voltage that the back EMF is riding on fluctuates as torque requirements of motor 88 and the level of charge of battery 90 change. Due to this constant change in reference voltage, the detection of the back EMF signal can be difficult. In order to eliminate the voltage fluctuations from effecting the measurement of the back EMF, the voltage supplying the power to motor 88 is suspended and motor 88 is allowed to coast for a predetermined amount of time. During this coast interval, the back EMF signal is the sole producer of any electrical signal and can be easily detected at terminals 93 and 94. During this coast interval, the back EMF signal may be sensed and the speed of motor 88 is determined. After the predetermined coast time, the power is then re-applied to motor 88 to continue dispensing of the towel. The coast interval is long enough to allow adequate sampling of back EMF to determine rotation speed but not so long as to allow significant slowing of motor 88 and drive roller 32 to impact the speed of towel dispensing.

The length of time that motor 88 is operating and the speed at which motor 88 is operating will determine the length of towel dispensed. However, motor 88 will not be able to accelerate from rest to a steady operating speed immediately upon application of electrical current to terminals 93 or 94. Some time will be required for the motor to reach a steady operating speed. The total length of time for dispensing a towel and the rate of acceleration from a resting position will depend largely on the level of charge and thus the level of voltage and current supplied by battery 90. As the level of charge drops through operation of dispenser 10, less current and voltage will be supplied, resulting in a slower acceleration and a slower steady operating speed. Thus, the time of operation of motor 88 required to dispense the desired length of towel will fluctuate with the level of charge of battery 90.

One method of determining the run time required of motor 88 to dispense the desired length of towel is to start supply power to motor 88 to begin the dispensing and allowing motor 88 to reach a steady operating speed. Then, stop supplying power to motor 88 and allow motor 88 to coast. While the motor is coasting, determine the steady speed at which towel is being dispensed. Using the speed the towel is being dispensed at, along with the run time of motor 88, the length of towel dispensed can be estimated. From this length and the speed of motor 88 during the coast period, how much, if any, additional run time is required to dispense the desired length of towel can be determined. Since the speed of motor 88 during the coast interval when the back EMF is detected is used to determine the amount of total run time of motor 88, the timing of the coast period during the run time where the back EMF is sensed is critical. If the back EMF is sampled prior to motor 88 reaching a steady operating speed, dispenser 10 will dispense more towel than is desired. If motor 88 is allowed to run for too long before the coast interval, too much towel may be dispensed. The time from the initial application of current to motor 88 to the time that motor 88 reaches the steady operating speed is mostly dependant on the amount of paper remaining on the roll and the strength of the battery.

Control circuit 98 on circuit board 81 includes an algorithm designed to sample the speed when dispenser 10 has expelled ¾ of the expected paper for the current request. Since past knowledge of the time to dispense towel of a specified length is required to determine the ¾ point, history of the run times are retained by a run time memory in control circuit 98. If battery 90 has been replaced, the history of prior run times in the run time memory may be lost and dispenser 10 will have no past information of prior run times. In this instance, a pre-set default value may be used. This default value is calculated based on the expected charge of a new battery 90 and the speed at which such a fresh battery may drive motor 88. The default value for estimated run time is stored in a default value table within control circuit 98.

Control circuit 98 may also include a low power sleep mode that can be used to conserver battery power. Control circuit 98 will normally be in a deep sleep mode to conserve the energy available from battery 90. Periodically, control circuit 98 will wake up from the sleep mode to verify is a dispensing request has been received from a sensor behind indicator arrow 82. In the present embodiment, control circuit may wake up 7 times a second to check for a signal to dispense a towel. Other periodic intervals and durations of sleep mode may be used within the scope of the present invention.

Figure 10:
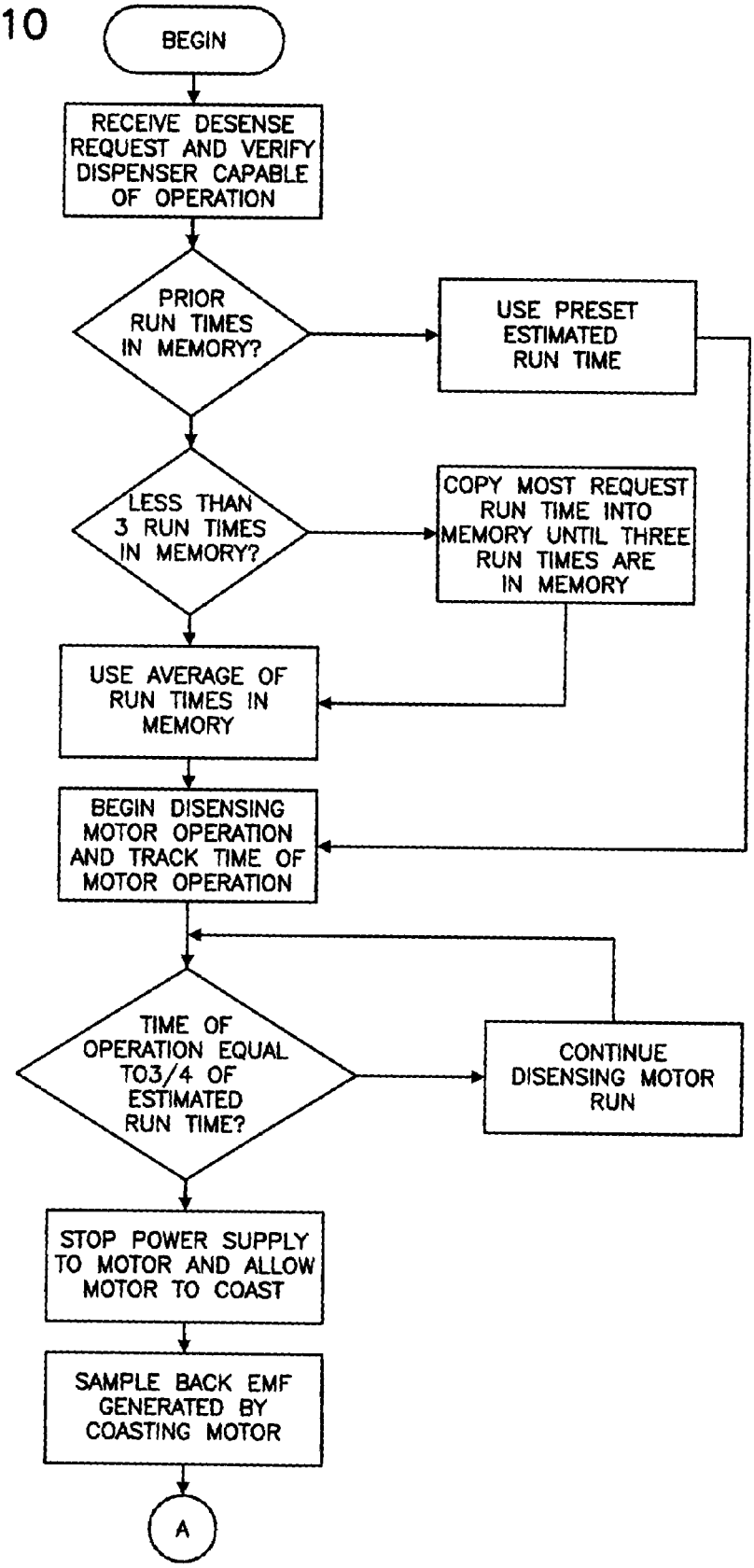
FIG. 10 is a first portion of a process diagram illustrating the determination of motor run time of the dispenser of FIG. 1 to dispense a desired length of towel.
Figure 11:
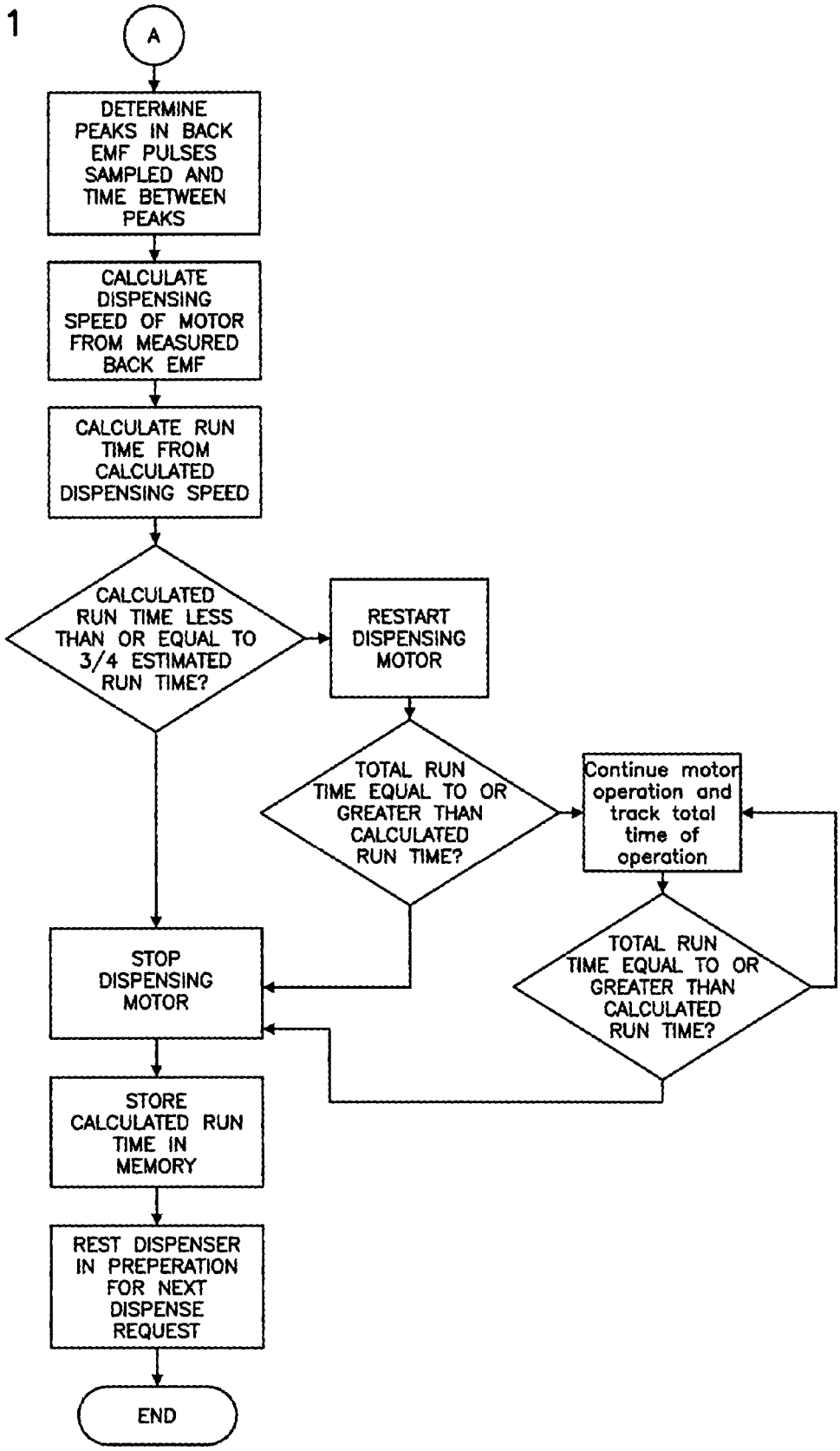
FIG. 11 is a second portion of the process diagram of FIG. 10.

The diagram of FIGS. 10 and 11 shows the logical flow process performed by control circuit 98 according to the present invention. As described in the earlier patents incorporated by reference, the process of dispensing a towel begins with the sensing of movement of by the sensor behind indicator arrow 82. When the sensor behind indicator arrow 82 senses a triggering event, a signal is sent to control circuit 98 to initiate the process beginning in FIG. 10. Control circuit 98 determines if dispenser 10 is prepared to dispense when the signal is received. If dispenser 10 is ready to dispense, control circuit 98 checks the run time memory to see if three prior run times are stored. If three run times are stored, control circuit 98 computes an average of the three stored run times and this average time is used as an estimated run time. If no run times are stored in the run time memory, then control circuit 98 defaults to the pre-set stored value. If one or two values are stored, the most recent run time in the run time memory is used two or one additional times, respectively, to allow computation of an average of three run times to set the estimated run time.

Once an estimated run time has been computed or the pre-set value is selected, power may be supplied from battery 90 to motor 88 and a timing circuit and a counter in control circuit 98 on circuit board 81 are simultaneously started. The counter counts records the time from the initial supply of power to motor 88, as generated by the timing circuit. Once the counter has reached a time equal to ¾ of the estimated run time determined above, the power to motor 88 is cut off and motor 88 is allowed to coast for a pre-set length of time. During this coast period, control circuit 98 samples and records the peak values of back EMF in an EMF memory along with the time those peaks were sensed. The time difference between the recording of peaks in back EMF may be directly correlated to the speed at which motor 88 is rotating during the coast period. Once the coast period has expired and peaks of back EMF have been stored in EMF memory, control circuit 98 may then determine the speed of motor 88 by comparing the time between peaks of back EMF to a table within dispensing memory of control circuit 98. From the table, control circuit 98 receives a calculated run time for motor 88 to dispense the desired length of towel.

If the calculated run time is less than or equal to ¾ of the estimated run time plus the coast period, control circuit 98 will not reapply power to motor 88 and the dispensing cycle will be complete. If the calculated time is greater than ¾ of the estimated run time plus the coast period, control circuit 98 will reapply power from battery 90 to motor 88 and allow the timer to continue tracking timer. Once the timer indicates that the calculated run time is up, control circuit 98 will cease power delivery to motor 88 and the dispensing cycle will be complete. Once the dispensing cycle is complete, the calculated run time is stored in the run time memory of control circuit 98. If three times are already in the run time memory, the most current run time will replace the oldest run time in the memory.

Control circuit 98 of dispenser 10 is configured to have a timing interval of approximately twenty microseconds. This allows control circuit 98 to control run times in increments of twenty microseconds. Control circuit 98 is also configured to sample back EMF at intervals of eighty microseconds and is adapted to record the value of the back EMF at those intervals. Control circuit 98 is further configured to coast motor 88 during the estimated run time of a dispense cycle for approximately ten milliseconds. This coast interval is sufficient to permit a sufficient number of back EMF samples to be recorded to accurately determine the speed of motor 88.

Back EMF as generated by an electric motor such as motor 88 during operation may be in a wave form rising to a maximum value above zero and falling to a minimum value below zero. The spacing between adjacent maximum or minimum values is used to determine the speed at which motor 88 is rotating during the coast period. Control circuit 98, as noted above, is configured to sample back EMF at intervals of eighty microseconds. As configured, motor 88 running at a steady operating speed with battery 90 at full charge will generate EMF pulses with spacing of approximately 900 microseconds between adjacent maximum values or adjacent minimum values. When battery 90 is nearly depleted, motor 88 running at a steady operating speed will generate EMF pulses spaced approximately three milliseconds between adjacent maximum values or adjacent minimum values. Control circuit 98 records the value of the back EMF at the sampling interval and determines the time interval between adjacent maximum or minimum values of back EMF. Control circuit 98 samples back EMF at the negative terminal of battery 90.

As the beginning of the coast period may not exactly coincide with a maximum or minimum value of back EMF, control circuit 98 is configured to record at least two minimum values within the back EMF signals. Once two minimum values have been identified, the time spacing between the two minimum values can be determined and thus the speed of motor 88 calculated.

It is anticipated that other sampling rates, timing intervals, coast time and motor operating parameters may be used within the scope of the present invention. The motor operating parameters should create back EMF signals at wave length small enough to have several adjacent maximum or minimum values within the coast time at normal full battery and nearly depleted battery conditions. The sampling rate should be sufficiently small compared to the wave lengths of expected back EMF signals to permit enough back EMF signals to be recorded during the coast interval to accurately determine the rotational speed of the motor.

Figure 12:
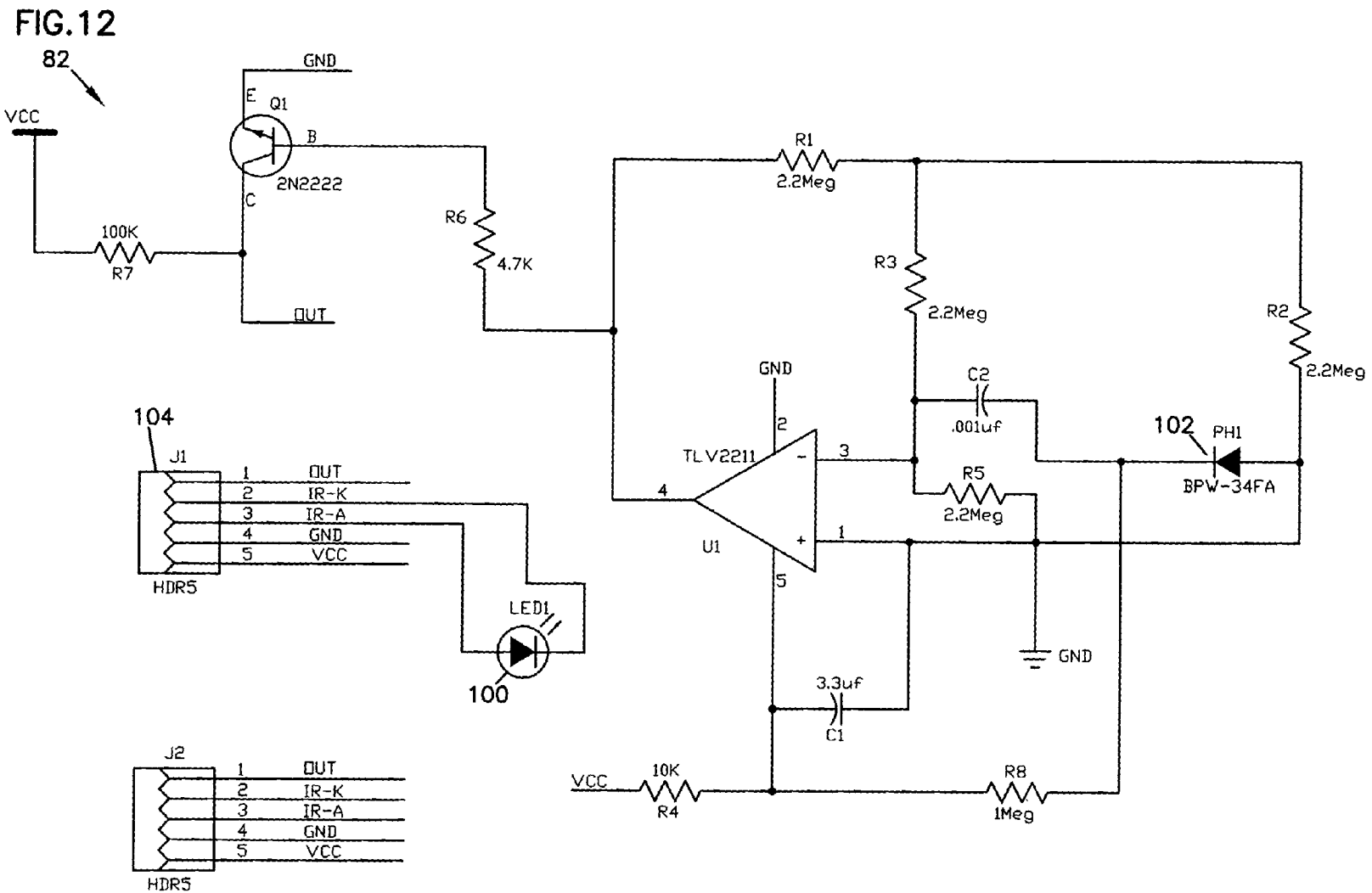
FIG. 12 is a schematic diagram of an embodiment of a sensor for detecting a towel dispensing request in a towel dispenser according to the present invention.
Figure 13:
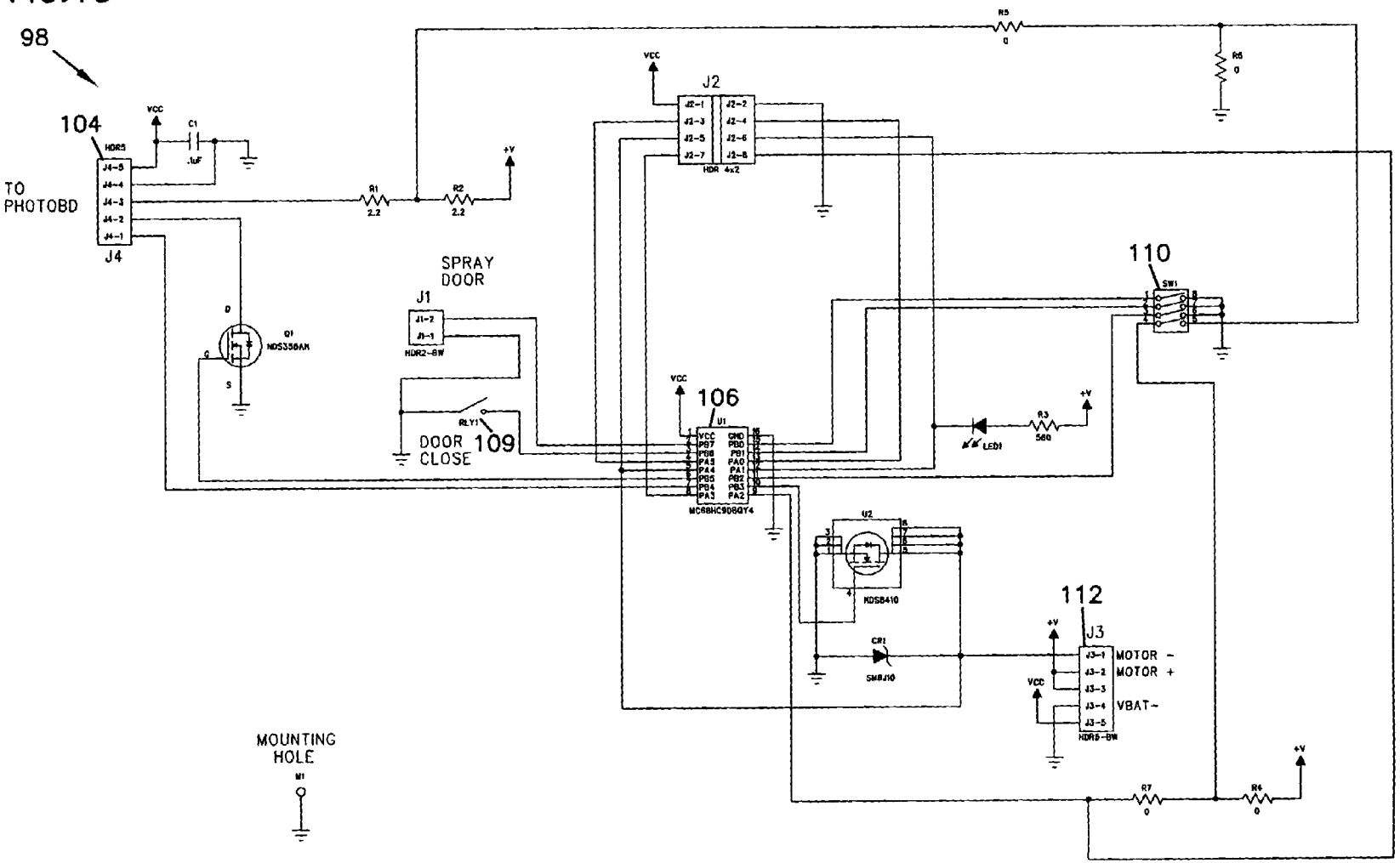
FIG. 13 is a schematic diagram of an embodiment of a control circuit for a towel dispenser according to the present invention.

Sensor board 101 which generates the signal to initiate a dispensing process may include an infrared (IR) LED as transmitter 100 and photodiode as receiver 102 as shown in FIGS. 3 through 9, above. A schematic diagram of IR transmitter 100 and receiver 102 pair is shown in FIG. 12 and a schematic of control circuit 98 is shown in FIG. 13. The state of IR transmitter 100 is controlled via a junction 104 of control circuit 98. As shown, control circuit 98 includes a microprocessor 106 which does not have drive capability to directly control IR transmitter 100, thus, a Field Effect Transistor (FET) 108 may be used to provide this drive. Control circuit 98 drives a gate of FET 108 to high level, which biases FET 108 and allows electrical current to flow to transmitter 100. This electrical current will cause IR transmitter 100 to emit an infrared beam of light. IR receiver 102 will normally output a high signal in the absence of any infrared light. When a sufficient amount of IR energy is present, IR receiver 102 will output a low signal, which is monitored by microprocessor 106. When continuous IR energy is detected, receiver 102 will saturate and the output of receiver 102 will return to a high level even though an infrared signal is still present. To prevent this from occurring, IR transmitter 100 is only allowed to be active for 100 $\mu$s followed by 400 $\mu$s of inactivity, allowing receiver 102 to dissipate any stored energy.

The use of active IR permits very short range sensing, such as within a range of about 5 inches to about 10 inches. It is important that the sensing distance not be too great, in order to prevent sensing of an individual or object from far away and thereby prevent an unintended dispense of paper toweling. Dispenser 10, incorporating an IR LED 100 and an IR receiver 102, may flood a target area with IR light and then senses only that IR reflected by an object, such as a user's hand(s). The IR is emitted in short pulses at a predetermined frequency, which not only requires low energy, but prevents dispenser 10 from being activated by ambient lighting since the ambient lighting is unable to synchronize with the pulses and frequency of the IR light emitted by dispenser 10.

A detection cycle or sample period begins each time dispenser 10 wakes from a deep sleep. IR transmitter 100 is enabled and a 100 $\mu$s timer is stated. While transmitter 100 is enabled, receiver 102's signal is continuously sampled. If an object, such as a hand or arm, is within range of the receiver 102, the energy being emitted by transmitter 100 will be reflected back to receiver 102. If enough energy is reflected back to receiver 102, the output of receiver 102 will go low and be detected by control circuit 98. If the control circuit 98 detects this potential dispense request signal from IR receiver 102, the power to transmitter 100 is terminated along with the 100 $\mu$s timer. If the 100 $\mu$s timer expires prior to detecting a dispense request signal from receiver 102, the power to the transmitter 100 is terminated and a 50 $\mu$s timer is started. Due to some delays caused by the IR detector of receiver 102, the signal from receiver 102 may not appear until after transmitter 100 has been deactivated. During this 50 $\mu$s delay, receiver 102 is continuously sampled. If the 50 $\mu$s timer expires before a signal from receiver 102 is seen, control circuit 98 will go into a deep sleep until the next sample period is required.

If a potential dispense request signal from receiver 102 is detected during the 100 $\mu$s or the following 50 $\mu$s timing interval, the signal is further qualified prior to initiating the dispensing of a towel. After a delay of 400 $\mu$s, transmitter 100 is again enabled for 100 $\mu$s, plus a possible additional 50

μs. Again the signal from IR receiver 102 is sampled and tested for a positive indication that an object is within range of the sensor circuit 101. If a positive indication is received, a potential dispense request signal to signal the vend start has again occurred. This sampling scenario continues until a programmable number of consecutive potential dispense request signals have been detected. Control circuit 98 may be programmable to require a number of positive iterations before initiating the dispensing of a towel. This should reduce the number of accidental or inadvertent dispensing signal being received and help reduce waste.

Once the required number of iterations is seen to signal that a towel should be dispensed, an inactivity count is check to determine if the current signal to dispense should be processed. For example, a requirement may be that at least 3 consecutive IR detection iterations must result in a no-detect between each valid dispensing signal. This prevents an object that is placed in front of transmitter 100 and receiver 102 from causing dispenser 10 to continually dispense towels while the object is stationary. The object that caused the previous towel dispense action must be clear from IR receiver 102's detection range for at least 3 sampling periods before a valid dispense signal will again be processed. The inactivity count may begin at a count of 3. Each iteration that results in a no-detect will cause the iteration count is decremented by one until the count reached zero. If a detect is encountered prior to the inactivity count reaching zero, the count is incremented by one until the count reached a maximum value of 5. In this way, signals received from the sensor behind indicator arrow 82 may be verified and qualified before control circuit 98 initiates the dispensing of a towel.

Also shown in FIG. 12 are other electrical elements which serve to amplify and deliver the signal generated by receiver 102 to control circuit 98. Also shown in FIG. 13 are other electrical elements for delivering signals to and from microprocessor 106 of control circuit 98. One of these is a switch 109 which indicates whether cover 24 is open or closed. If cover 24 is open, control circuit 98 will not permit the dispensing of any towels. A switch 110 is provided to allow selection of desired towel length, as will be described further below. A junction 112 is provided so power may be transmitted to motor 88 when a valid dispensing request has been received.

In prior art towel dispensers, such as those incorporated herein by reference, the length of towel dispensed is a whole multiple of the circumference of drive roller 32. The present invention may incorporate a switch or switches in control circuit 98 mounted to circuit board 81 which may permit a selection of a greater variety of towel lengths. As described above, the length of towel dispensed is based on the speed and run time of motor 88 driving roller 32. The position of the switch or switches may determine which value from the table of default values for run time that control circuit 98 will reference in case no run times are stored in the calculated run time memory. Switching from one desired length of towel dispensed to another will delete any times stored in the calculated run time memory. Thus, the first time after switching the desired length of towel dispensed, control circuit 98 will default to the value in the default value table corresponding to the new length of towel desired. As dispenser 10 dispenses additional towels at the new desired length setting, the calculated run time memory will be filled with values corresponding to the new length.

If a switch is present in control circuit 98 of dispenser 10, the default pre-set run times memory of control circuit 98 may include a number of default run times equal to the number of different selectable desired dispense lengths. Alternatively, control circuit 98 may only have a single universal default value in the pre-set run time memory. Whenever the dispense length is changed, the first time dispenser 10 dispenses a towel, this same value will be used as the estimated run time, regardless of the length selected. However, once the first dispense request has been received and the towel dispensed, the first calculated run time is in memory and will provide the basis for using a more accurate estimated run time for future dispensing operations. This fall back to the universal default value for run time would also apply when battery 90 is changed and the contents of the calculated run time memory is emptied.

Dispenser 10 may also be configured to include a paper jam and low battery detection function within control circuit 98. When the timer controlling the coast time of the motor expires, the pulse width value detected through the use of back EMF is examined. If the pulse width value is zero, the one of two error conditions has occurred. Either the battery is too low to drive motor 88 or motor 88 is in a paper jam situation. Further processing of the back EMF signal can make a distinction between a jam and a low battery, but since both errors are handled in the same manner, there is not need to perform any further processing.

If the pulse width value is zero, a Boolean flag may be set within control circuit 98 that signals that an error has occurred. When control circuit 98 detects such an error, the vend cycle is halted, the motor drive is disabled and the dispense cycle is ended with an error. Dispenser 10 then reverts back to standard functioning and resets to sense the next dispense request. When a dispense cycle ends in such an error, a variable maintained by control circuit 98 may be incremented by one and tested against a programmable value that represents the number of consecutive Low Battery/Jam error occurrences before any action is taken. The present invention may be set to a default value is set to 3. If three consecutive instances of a Low Battery/Jam is detected, dispenser 10 may refuse any further dispense requests until front cover 24 is opened, the reason for the problem (a paper jam or a weak battery) is corrected and cover 24 is closed. The opening and closing of cover 24 will be signaled to control circuit 98 by the position of switch 109.

Control circuit 98 of dispenser 10 may also be configured with a pair of two position switches to set the desired length of towel dispensed. These switches may also be mounted to circuit board 81 separate from control circuit 98 in an alternative embodiment. This combination of switches provides up to four different towel lengths that may be selected. In conjunction with this number of alternative lengths, the default pre-set estimated run time memory of control circuit 98 includes the space for storing up to four different default estimated run times, one corresponding to each of the alternative lengths. Other configurations of more or fewer alternative lengths and more or fewer alternative default estimated run times may be incorporated into control circuit 98 within the present invention.

The embodiments of the inventions disclosed herein have been discussed for the purpose of familiarizing the reader with novel aspects of the invention. Although preferred embodiments have been shown and described, many changes, modifications, and substitutions may be made by one having skill in the art without necessarily departing from the spirit and scope of the invention.

What is claimed is:

1. A hands-free towel dispenser comprising:

a housing with a roll of towels inside an interior;

a sensor for detecting the presence of an object and generating a signal;

a motor driving a dispensing means for dispensing a desired length of towel;

a control circuit for receiving the signal from the sensing means and controlling supply of power to the motor driving the dispensing mechanism;

a power source supplying power to the motor and the control circuit;

the control circuit adapted to sample back EMF generated by the motor while the dispensing means is dispensing the towel and to determine based on the sampled back EMF a calculated run time for the operation of the motor to dispense the desired length of towel, wherein the control circuit stops the supply of power to the motor momentarily and allows the motor to coast while the dispensing means is dispensing the towel and samples the back EMF during the coast period.

2. The hands-free towel dispenser of claim 1, wherein the control circuit stops the supply of power to the motor for approximately ten milliseconds and allows the motor to coast while the dispensing means is dispensing the towel and samples the back EMF during the coast period.

3. The hands-free towel dispenser of claim 1, wherein prior to supplying power to the motor, the control circuit determines an estimated run time for dispensing the desired length of towel.

4. The hands-free towel dispenser of claim 3, wherein the control circuit momentarily stops the supply of power to the motor and allows the motor to coast when the motor has reached a steady operating speed.

5. The hands-free towel dispenser of claim 4, wherein the control circuit momentarily stops the supply of power to the motor when approximately seventy-five percept of the estimated run time has elapsed.

6. The hands-free towel dispenser of claim 5, wherein the control circuit is adapted to compare the estimated run time with the calculated run time and adjust the length of time that power will be supplied to the motor to dispense the desired length of towel.

7. The hands-free towel dispenser of claim 3, wherein the control circuit can be configured to dispense a plurality of selectable desired towel lengths.

8. The hands-free towel dispenser of claim 7, wherein the control circuit includes an estimated run time memory adapted to store a plurality of default estimated run times, with an estimated run time corresponding to each of the plurality of selectable desired towel lengths.

9. The hands-free towel dispenser of claim 7, wherein the control circuit includes switch to allow user selection of up to four desired towel lengths.

10. The hands-free towel dispenser of claim 7, wherein the control circuit includes a calculated run time memory for storing previous calculated run times corresponding to the currently selected desired towel length and the estimated run time is determined by averaging the calculated run times within the calculated run time memory.

11. The hands-free towel dispenser of claim 10, wherein selecting a different desired towel length from the plurality of desired towel lengths will erase the previous calculated run times stored in the calculated run time memory.

12. The hands-free towel dispenser of claim 11, wherein the control circuit includes a plurality of pre-set default estimated run times, with a pre-set default estimated run time corresponding to each of the desired towel lengths, the respective default estimated run times to be used if no previous calculated run times are stored in the calculated run time memory.

13. The hands-free towel dispenser of claim 10, wherein the calculated run time memory stores up to the three most recent calculated run times.

14. The hands-free towel dispenser of claim 3, wherein the control circuit includes a calculated run time memory for storing previous calculated run times and the estimated run time is determined by averaging the calculated run times within the calculated run time memory.

15. The hands-free towel dispenser of claim 14, wherein the control circuit includes a pre-set default estimated run time to be used if no previous calculated run times are stored in the calculated run time memory.

16. The hands-free towel dispenser of claim 14, wherein the calculated run time memory stores up to the three most recent calculated run times.

17. A method of dispensing a desired length of towel comprising:

providing a roll of towels within a housing, a sensor for sensing the presence of an object, a power source and a motor driving a dispensing means;

the sensor generating a signal when the presence of an object is sensed;

a control circuit receiving the signal from the sensor and supplying power from the power source to the motor to drive the dispensing means to dispense a desired length of towel from the roll;

the control circuit stopping the supply of power to the motor momentarily and allowing the motor to coast while the dispensing means is dispensing the towel and sampling back EMF during the coast period;

the control circuit determining the speed of operation of the motor driving the dispensing means by using the back EMF signals generated by the motor;

the control circuit calculating a calculated run time the motor should drive the dispensing means to dispense the desired length of towel based on the speed of operation of the motor as determined from the back EMF signals generated by the motor;

the control circuit stopping the supply of power to the motor when the motor has run for the calculated run time.

18. The method of claim 17, further comprising the control circuit stopping the supply of power to the motor for approximately ten milliseconds and allowing the motor to coast while the dispensing means is dispensing the towel and sampling the back EMF during the coast period.

19. The method of claim 17, further comprising the control circuit determining an estimated run time for dispensing the desired length of towel prior to supplying power to the motor in response to the signal.

20. The method of claim 19, further comprising the control circuit momentarily stopping the supply of power to the motor, allowing the motor to coast when the motor has reached a steady operating speed, and sampling the back EMF while the motor is coasting.

21. The method of claim 20, wherein the control circuit momentarily stops the supply of power to the motor when approximately seventy-five percent of the estimated run time has elapsed.

22. The method of claim 21, further comprising the control circuit comparing the estimated run time with the calculated run time and adjusting the length of time that power will be supplied to the motor to dispense the desired length of towel based on the difference between the estimated and the calculated run times.

23. The method of claim 19, wherein the control circuit can be configured to dispense a plurality of selectable desired towel lengths.

24. The method of claim 23, wherein the control circuit includes a switch to allow user selection of up to four desired towel lengths.

25. The method of claim 23, wherein the control circuit includes an estimated run time memory adapted to store a plurality of default estimated run times, with an estimated run time corresponding to each of the plurality of selectable desired towel lengths.

26. The method of claim 23, wherein the control circuit includes a calculated run time memory for storing previous calculated run times corresponding to the currently selected desired towel length and the control circuit averaging the calculated run times stored in the calculated run time memory to determine the estimated run time when the signal is received.

27. The method of claim 26, wherein the control circuit includes a plurality of pre-set default estimated run times, with a pre-set default estimated run time corresponding to each of the desired towel lengths and the control circuit using the default estimated run time corresponding to the currently selected desired towel length if no previous calculated run times are stored in the calculated-run time memory.

28. The method of claim 26, wherein the calculated run time memory stores up to the three most recent calculated run times.

29. The method of claim 19, wherein the control circuit includes a calculated run time memory for storing previous calculated run times and the control circuit averaging the calculated run times stored in the calculated run time memory to determine the estimated run time when the signal is received.

30. The method of claim 29, wherein the control circuit includes a pre-set default estimated run time and the control circuit using the default estimated run time if no previous calculated run times are stored in the calculated run time memory.

31. The method of claim 29, wherein the calculated run time memory stores up to the three most recent calculated run times.

* * * * *